United States Patent [19]

Beekmans

[11] Patent Number: 4,809,309

[45] Date of Patent: Feb. 28, 1989

[54] X-RAY EXAMINATION APPARATUS WITH A LOCALLY DIVIDED AUXILIARY DETECTOR

[75] Inventor: Antonius A. G. Beekmans, Eindhoven, Netherlands

[73] Assignee: U.S. Philips Corporation, New York, N.Y.

[21] Appl. No.: 173,682

[22] Filed: Mar. 24, 1988

Related U.S. Application Data

[63] Continuation of Ser. No. 908,131, Sep. 17, 1986.

[30] Foreign Application Priority Data

Sep. 20, 1985 [NL] Netherlands ..... 8502569

[51] Int. Cl.[4] ..... H05G 1/64

[52] U.S. Cl. ..... 378/99; 358/111; 250/213 VT

[58] Field of Search ..... 378/97–99, 378/108; 358/111; 250/213 VT

[56] References Cited

U.S. PATENT DOCUMENTS

| | | | |
|---|---|---|---|
| 3,567,854 | 3/1971 | Tschantz | 378/99 |
| 3,784,816 | 1/1974 | Abrahamsson | 378/99 |
| 3,912,936 | 10/1975 | Cunninghame et al. | 378/98 |
| 4,204,225 | 5/1980 | Mistretta | 358/111 |
| 4,220,890 | 9/1980 | Beekmans | 313/527 |
| 4,335,307 | 6/1982 | De Vries et al. | 378/97 |
| 4,412,247 | 10/1983 | Horbaschek | 378/99 |
| 4,442,538 | 4/1984 | Haendle | 378/99 |
| 4,442,539 | 4/1984 | Aichinger et al. | 378/99 |
| 4,472,826 | 9/1984 | van de Ven | 378/97 |
| 4,473,843 | 9/1984 | Bishop et al. | 358/111 |
| 4,517,594 | 5/1985 | Horbaschek | 378/99 |
| 4,590,603 | 5/1986 | Relihan et al. | 378/108 |
| 4,595,949 | 6/1986 | Fenster et al. | 378/99 |
| 4,677,477 | 6/1987 | Plut et al. | 378/99 |

FOREIGN PATENT DOCUMENTS

| | | | |
|---|---|---|---|
| 0226569 | 12/1984 | Japan | 358/111 |
| 0226342 | 12/1984 | Japan | 378/99 |

OTHER PUBLICATIONS

"Self-Scanning Photodiode Arrays for Spectroscopy", by Show Research Development, 4–1976.

*Primary Examiner*—Craig E. Church
*Assistant Examiner*—John C. Freeman
*Attorney, Agent, or Firm*—Thomas A. Briody; Jack E. Haken

[57] ABSTRACT

X-ray examination apparatus includes a detector array 32 for the detection of the light beam 10. The array is set up in such a manner that image information from substantially the entire output screen of an X-ray image-intensifier tube incorporated in the apparatus can be detected. The detector array is used for brightness control and for adaptation of the quantities influencing the image quality. Use is made of a measured field which can be programmed spatial image imformation can also be used by the matrix form of the detector.

9 Claims, 1 Drawing Sheet

X-RAY EXAMINATION APPARATUS WITH A LOCALLY DIVIDED AUXILIARY DETECTOR

Figure 1:
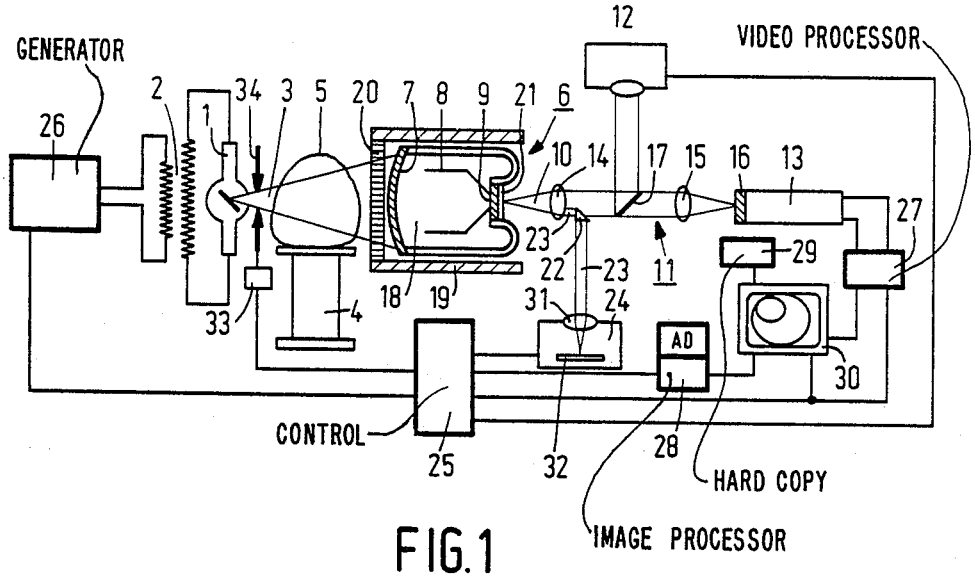

This is a continuation of application Ser. No. 908,131, filed Sept. 17, 1986.

The invention relates to an X-ray examination apparatus equipped with an X-ray image intensifier with an input screen and an output screen, with an image-processing and an image-recording device and with an auxiliary light-detection system for selection and detection of a partial beam comprising image information from, at least nearly the entire output screen An X-ray examination apparatus of this kind is known from U.S. Pat. No. 4,472,826. In an apparatus described there a partial light beam which is selected from the light beam by a beam selector is converted via a light detector into a signal for brightness control of the apparatus. By placing diaphragms in a beam path of the partial beam selected for detection a partial area of the output screen can be selected for the formation of a brightness signal By this selection of the measured field it is possible to ensure that partial areas from the image which make only a small contribution or no contribution at all to the image information are excluded from participation in the brightness control The exchanging or adjustment of diaphragms for choice of the measured field is a relatively time-consuming operation and the number of measured fields and also the freedom to position them over the entire image is very limited and because adaptation to the image content is not possible on line, the method produces faulty brightness control in practical cases. This objection is all the greater if the image formation has to meet more exacting requirements and efforts are taken to ensure lower radiation doses.

Known auxiliary light-detection systems derived from the selected partial beam, even if the latter geometrically contains substantially the entire image, only yield information about the total luminous flux and therefore deliver a signal correlated to the integrated or average brightness. With the increasingly exacting demands for contrast and resolving power for diagnostic image a need is arising for an image control system giving access also to spatial brightness data and contrast data on the image The invention is aimed at overcoming these objections and to that end an X-ray examination apparatus of the kind stated in the preamble is characterized by the fact that the auxiliary light-detection system comprises a two-dimensional set of photodetectors.

In an apparatus according to the invention it is now possible, by electronic control or, if desired, fully automatically, to select any arbitrary measured fields for brightness control. In the selection process all mechanical operations are avoided and the measured field can be programmed a priori as desired or be chosen on line as a result of the image content being viewed.

Since, however, separately readable image elements also occur in a measure field which, again, may comprise essentially the entire image, information concerning the contrast and brightness distribution in the image-intensifier output image can be derived from auxiliary detection signals. With this information it is now possible, in addition to the usual overall illumination control, also to optimise the contrast and the brightness distribution.

In a preferred embodiment the detector array comprises a system of orthogonally arranged photodetectors, for example photosensitive CCD elements which are individually controllable linearly in two directions. An array of this kind may contain, for example, between $8\times8$ and $64\times64$ photodetectors.

With the aid of a detector array thus constructed and positioned, it is now possible to record and evaluate an output image from the image-intensifier tube before, during and, if desired, even after the actual image formation in the apparatus. Information thus obtained concerning the image structure, in which particularly the local brightness but also the contrast and the brightness dynamics are relevant, can be used for adjustment and control of the number of image-determining quantities in the apparatus. Thus, for example, a signal derived from substantially the entire array can be used for general illumination control so that automatic gain control, if desired fully automatic, is achieved.

By selecting a proportion of the detector elements, for which purpose only a portion of the detector elements need be switched out of service, a measured field can be determined which can be chosen arbitrarily as to size, geometry and position within the image. For example, a measured field can be determined in advance for which the nature of the examination together with the shape of the object may be decisive. With a signal derived from detector elements located within a measured field the brightness of the entire image can be optimised and adapted to more relevant image contents. The shape of the measured field in this process can be adapted to, for example, the diaphragm aperture for the X-ray beam in the apparatus. If, for example, the diaphragm has to mask a part of the measured field, that part is excluded from further participation. This adaptation can now be easily performed by a switching-mechanism, (e.g. one operated by a diaphragm-controlled system which selects the detector elements).

On the other hand, by setting a maximum permissible value for individual detector-element signals, the measured field can also be easily adapted to the occurrence of bloom in the image. "Bloom" occurs in the image partial areas where the X-ray beam impinges on the input screen without passing through the object. Detector elements thus "swamped" within the chosen measured field can be excluded, on the basis of the maximum value, from participation in the brightness control. Thus there is automatic adaptation of the measured field to the shape of an object to be examined for which purpose diaphragming is performed, even if imperfectly, and this gives rise to blooming. In both cases, therefore, i.e. with diaphragming and blooming within the measured field, another detector element can be added for each detector element thus excluded. The measured field thus wanders, so to speak, over the image and the geometrical matching between the measured-field signal and the overall image intensity maintains a fixed value. An additional advantage of this is that the dynamic range of the measured-field signal is not increased unnecessarily, so that added control accuracy is obtained. A travelling measured field is also a good thing for dynamic examination of more peripheral parts of the body. Thus it is possible to have the measured field follow, even if relatively roughly, a selected blood vessel throughout an entire exposure cycle for the purpose of angiography.

A marked improvement in imaging can also be obtained with a measured-field detection system according to the invention in apparatuses with digital image-processing, e.g. as described in U.S. Pat. No. 4,204,225. A disadvantage of this type of apparatus is that an entire picture has always to be digitalized into a relatively large number of grey-scale bits. By directing the choice of measured field so that an effective range of grey-scale values is determined for a relevant partial area of the image, the digitalization of the whole image can be restricted to that field without any loss of image information. For each measured-field image element the grey-scale value can be adapted in this process so that the dynamic range of the image as a whole can be reduced markedly without relevant image information being lost. On the other hand, it is then also possible, while maintaining a maximum number of bits to be processed, to transform the relevant information in the image with, for example, a higher intensity-resolving power, so that an image improvement can be achieved.

The auxiliary detection system according to the invention provides sufficient information for the construction of a histogram of the image content. With its aid the image-processing parameters to be applied to the output image of the image intensifier, such as the dynamic range and the slope or gamma of the brightness, can be adapted to the optimisation of relevant image information.

Some preferred embodiments of the invention will now be further described with reference to the drawing. In the drawing:

FIG. 1 shows an X-ray examination apparatus according to the invention

Figure 2A:
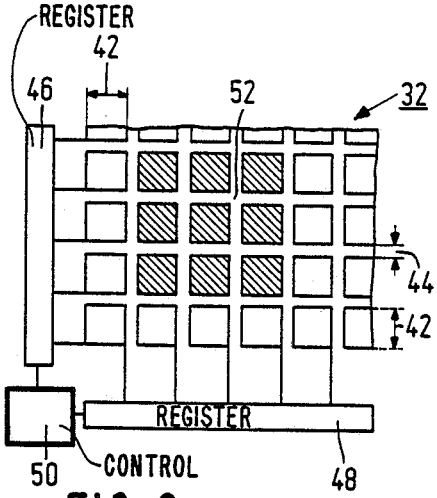
Figure 2B:
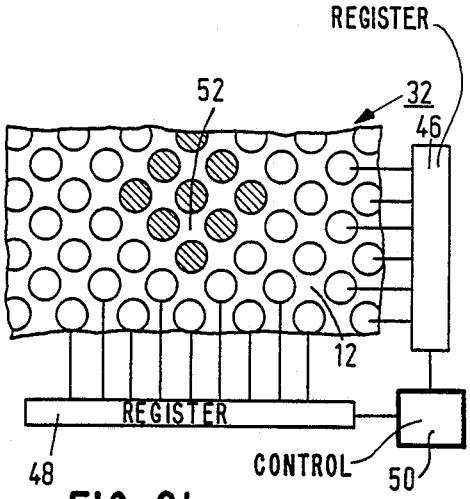

FIGS. 2*a* and 2*b* show various forms of embodiment of photodiode arrays for the same.

An X-ray examination apparatus as shown in FIG. 1 comprises an X-ray tube 1 with a power source 2 for the generation of an X-ray beam 3 for fluoroscopy of an object 5 located on the carrier 4. The X-ray beam carrying the image is received by an X-ray image-intensifier tube 6 with an input screen 7, an electron-optical system 8 and an output screen 9. A light beam 10 leaving the output screen is here imaged with the aid of an optical imaging system 11 on a ciné camera 12 on the one hand and on a television camera tube 13 on the other. The optical imaging system usually comprises a first lens 14 whose object focal plane coincides with the output screen 9, a second lens 15 whose image focal plane coincides with a target 16 of the television camera tube 13 and, between these two lenses, an image-transmission system 17, e.g. a semi-transparent and/or swing-away mirror with which the light beam can also be projected onto the ciné camera 12. To eliminate disturbing effects of, for example, electromagnetic fields on an electron beam 18, which images photoelectrons from the input screen onto the output screen, the X-ray image-intensifier tube is incorporated in a housing 19 with, for example, a trellis-shaped input grid 20 which, for example, in accordance with U.S. Pat. No. 4,220,890, combines the function of a scattered-radiation grid and that of a magnetic screen.

The light beam 10 generated in the output screen and leaving by an exit window 21 is shaped by lens 14 into a parallel beam. In the version shown here there is inserted between the two lenses an optical element 22 with which a part 23 of the imaging beam is deflected. The optical element 22 has here the form of a prism with which, for example, 0.1 to 1 percent or, if desired, more of the luminous flux from the imaging beam is deflected. The optical element can also be formed by a mirror set at an angle of approximately 45° and, if desired, partially transparent, by a bundle of optical fibres, etc. The element 22 directs the partial beam 23 to a measured-field selection device 24 which is connected to a central control device 25. From the central control device a generator 26 for the X-ray tube, a videosignal processing device 27 in the television chain of the apparatus, the ciné camera 12 and, for example, a device 28 with an A-D converter for digital image processing can be controlled. A monitor 30 is included for image display. It is also possible to work with two monitors with the first monitor, for example, always displaying the instantaneous image and the second displaying a processed image. From both monitors but particularly from the latter an image can, if desired, be recorded in a hard-copy unit 29.

The measured-field selection device 24 incorporates an optical imaging system 31, here shown as a single lens with which substantially the whole image from the exit window 9, but with, for example, only 0.1 to 1 percent of its luminous intensity, is displayed reduced on a photodetector array 32. The photodetector array as a whole can thus in fact detect at any rate practically the entire image, at least if all photodetector elements are actuated. Compared with the actual imaging in the ciné camera 12 or via the television camera tube 13, detection has a low resolving power because two or more image points of the output system to be imaged individually are projected on a photodiode as a single image point. The photodiode field, of, for example, $32\times32$ elements is often amply sufficient and, depending on the aim in mind, it will often be possible to do with fewer elements. If the image content in particular is also important, it is possible to work with, for example, $64\times64$ elements. The optical system 31 can be implemented as a single imaging system, by which is meant that the output screen is imaged as a continuous image on the array of photodiodes. Particularly with relatively small numbers of photodiodes it may be a good idea from the point of view of loss of light to construct the imaging system from an imaging system composed in accordance with the photodiode array, for example with a mini lens for each photodiode, with a system of cylindrical lenses or with an image-splitting fibre-optics system. Since semiconductor technology makes the construction of an array of photodiodes with a relatively large density possible, a multi-channel optical system, however, will often not offer much gain in intensity. The partial-beam selection element can also select an intensity section, e.g. of several per cent over the entire transverse measurement of the beam, for example with a mirror with a low degree of reflection. A mirror of this kind need then not necessarily be placed in the beam where geometrical selection is possible and can therefore be placed in front of lens 10 or after lens 15.

FIGS. 2*a* and 2*b* show a preferred form of implementation of diode arrays suitable for an apparatus of this kind. For a detailed description of photodiodes in general see, for example, Bell System Techn. Journal Vol. 49, pp. 587–593, 1970.

FIG. 2*a* shows a part of a photodiode array with an orthogonal structure in which each of the photodiodes is also orthogonal in form and each has a square active surface. The diodes are fitted in a slice of semiconductor material using the techniques familiar for its purpose from semiconductor technology. Ribs 42 of active surfaces are, for example, 0.8 mm while the spacings 44 between the diodes are, for example, 0.2 mm. An array of 32×32 photodiodes then has, apart from boundaries around it, dimensions of, for example, over 3×3 $cm^2$. The output screen is imaged on this surface. For that matter, it is also possible to work with much smaller photodiodes and their size is not relevant to the invention. Such a matrix of photodiodes can, for example, be driven from a column register 46 and a line register 48, both of which, are driven by a control device 50. The control device 50 is connected to the central control device 26 shown in FIG. 1. A measured field 52 which is in fact arbitrarily chosen is indicated by hatched photodiodes. FIG. 2*b* shows another orthogonal system of, in this case, circular photodiodes 50 which can be controlled individually in exactly similar fashion via a column register 46, a line register 48 and a control device 50. Here, too, a completely arbitrarily chosen measured field 52 is indicated. The photodiodes here have a diameter of, for example, 1 mm while the centre distance between successive rows and columns, respectively is, for example, 1.1 mm. With a detector array of 32×32 elements an image on the input screen of the image-intensifier tube is split into 32×32 elements. For a 14" tube this means that the image elements for this display on the input screen are approximately 10×10 $mm^2$. A television chain, often used in this type of equipment, with a high resolving power of, for example, 1,000 lines yields, projected on the same input screen, an image-element size of 0.3×0.3 $mm^2$. A measured-field image element thus comprises approximately 1,000 real image elements. The measured-field image element is thus determined directly here by the geometry of the photodetection itself. It may be useful to work with an array with a much larger resolving power, e.g. 512×512 elements. For application of the invention packages of, for example, 2×2, 4×4 or 8×8, etc. elements may then be grouped together for read-out and further control as a unit.

A signal derived from this detector array can, as also shown in FIG. 1, be led via the central control device to, for example, the generator 26 for the X-ray tube 1, via a control mechanism 33 for an X-ray diaphragm device 34 to the camera, via the video-signal processing apparatus 27 to the television camera 13, to the monitor 30 and to a setting section of an A-D conversion device 32. The output signal of the auxiliary detector can thus control signal transfer characteristics of the video processor 27 to adjust the dynamic range and the slope or gamma of the brightness of a visual representation of the image output. For the process for programming and for post-fluoroscopy to which reference has already been made, a preferably digital memory, for example, is incorporated in the central control device.

What is claimed is:

1. An X-ray examination apparatus comprising:

an X-ray tube for producing an X-ray beam;

an X-ray image intensifier tube having an input screen disposed for receiving an X-ray image from the X-ray beam and an output screen for producing an optical image;

image read out means, which includes an image signal processor, for producing a visual representation of the optical image;

optical means for transmitting the optical image from the output screen to the image read out means;

auxiliary light detecting means comprising a two-dimensional matrix of photodetector elements disposed in the form of an orthogonal matrix, for selecting and detecting a portion of the optical image being transmitted from the output screen to the image read out means which portion of the image contains image information from substantially the entire output screen, and for producing an output signal corresponding to said portion, the output signal being connected to control one or more signal transfer characteristics of the image signal processor; and means for individually controlling the photodetector elements by means of two mutually orthogonal line controls so that the output signal includes spatial image information from the output screen.

2. The X-ray examination apparatus of claim 1 wherein the output signal is connected to control a signal transfer characteristic of the image signal processor which affects the gamma of the brightness of the visual representation of the output image.

3. The X-ray examination apparatus of claim 1 wherein the output signal is connected to control a signal transfer characteristic of the image signal processor which affects the dynamic range of the visual representation of the output image.

4. The X-ray examination apparatus of claim 1 wherein the output signal is connected to control a signal transfer characteristic of the image signal processor which affects the brightness slope of the visual representation of the output image.

5. An X-ray examination apparatus of claimed in any of claims 1, 2, 3, or 4 further comprising means connected to the X-ray tube and to the auxiliary light detecting means for operating under the influence of the output signal from the

6. An X-ray examination apparatus as claimed in any of claims 1, 2, 3, or 4 further comprising means for selecting portions of the output signal so that the one or more image processor signal transfer characteristics are controlled by signals derived from less than all of the photodetector elements.

7. An X-ray examination apparatus as claimed in any of claims 1, 2, 3, or 4 in which the auxiliary light detecting means include means for suppressing photodetector element output signals above a predetermined maximum signal intensity.

8. The X-ray examination apparatus of claim 1 wherein the photodetector elements are photosensitive CCD elements.

9. The X-ray examination apparatus of claim 1 wherein the matrix comprises from 8×8 elements up to 64×64 elements.

* * * * *